US006904857B1

(12) United States Patent
Holden

(10) Patent No.: US 6,904,857 B1
(45) Date of Patent: Jun. 14, 2005

(54) BOAT LIFT SECURING DEVICE

(76) Inventor: Gregory Aaron Holden, 1502 Stone Chimney Rd. SW., Supply, NC (US) 28462

( * ) Notice: Subject to any disclaimer, the term of this patent is extended or adjusted under 35 U.S.C. 154(b) by 0 days.

(21) Appl. No.: 10/773,747

(22) Filed: Feb. 5, 2004

(51) Int. Cl.[7] ..... B63C 7/00
(52) U.S. Cl. ..... 114/51; 405/3
(58) Field of Search ..... 114/48, 51; 405/3; 182/142, 143, 145–149

(56) References Cited

U.S. PATENT DOCUMENTS

| | | | | |
|---|---|---|---|---|
| 2,652,694 | A | 9/1953 | Melges | 61/48 |
| 2,844,943 | A | 7/1958 | Kennedy | 61/48 |
| 3,084,517 | A | 4/1963 | Bell | 61/48 |
| 3,145,685 | A | 8/1964 | Kulick, Sr. | 114/220 |
| 4,804,296 | A | 2/1989 | Smath | 405/212 |
| 5,007,363 | A | 4/1991 | James | 114/219 |
| 5,037,242 | A | 8/1991 | Nill | 405/215 |
| 5,113,702 | A | 5/1992 | Capps | 114/219 |
| 5,445,101 | A | 8/1995 | Koch | 114/222 |
| 5,911,189 | A | 6/1999 | Ryan | 114/230 |
| 6,112,690 | A | 9/2000 | Anderson | 114/220 |
| 6,152,065 | A | 11/2000 | Gronstrand | 114/365 |
| 6,178,909 | B1 | 1/2001 | Palmer | 114/219 |
| 6,554,533 | B2 | 4/2003 | Godbersen | 405/3 |

*Primary Examiner*—Jesus D. Sotelo
(74) *Attorney, Agent, or Firm*—Michael E. Mauney

(57) ABSTRACT

A device secured to a submersible portion of a boat lift to stabilize the submersible portion of the boat lift from unwanted lateral movement. Elongated pipe-like devices are attached to a submersible portion of a boat lift in proximity to a piling. The device is mounted to the submersible portion of a boat lift so that movement caused by wind, wave, or current action that would force the submersible boat lift into lateral motion will be stopped by the pipe-like device, which comes into contact with the piling before the lateral motion becomes so large as to be undesirable.

13 Claims, 5 Drawing Sheets

BOAT LIFT SECURING DEVICE

FIELD OF THE INVENTION

This relates generally to an accessory to be used with a boat lift used in coastal, lake, or river waters. Boat lifts are used to raise a boat out of the water for storage purposes when a boat is not in use. The lift is usually designed to readily return the boat to water for use when convenient or necessary. This device secures a boat from horizontal movement caused by outside forces while using the boat lift.

BACKGROUND OF THE INVENTION

Recreational boating is a large industry in this country. Many people own a boat which is used for fishing, sightseeing, water skiing, or other recreational pursuits. Some boats are docked permanently in a marina or at some other permanent dock. However, many people have their boats in water only when the boat is in use. Consequently, the boat may be launched at a boat launch ramp from a trailer or other transport device when it is desired to use the boat and the boat replaced on the trailer after the use of the boat is complete.

Some recreational boaters are fortunate enough to live directly on navigable water. Ordinarily, the people who live on navigable water and use a boat will have a dock of some kind, usually a floating dock connected to the land where they may moor their boat while getting in and out of the boat and before and after use. However, leaving the boat in water creates problems of various kinds. First, marine organisms, vegetation, and the like may grow on the bottom of the boat, which can either damage the boat or certainly decrease the efficiency of the boat while passing through the water, thus slowing the overall performance of the boat. Second, if the boat is in a waterway where other boats pass, these boats may create wakes which can wash the moored boat into the dock or other structure, damaging both the structure and the boat. Consequently, most docks are equipped with various kinds of fenders, which may be old tires, inflatable rubber bladders, or the like. A variety of other expedients are employed, such as extendable whip mooring devices which hold the boat a predetermined distance away from the mooring structure to reduce the potential damage to the boat and to the dock from wakes, wave action, wind, or currents. However, these expedients still leave the boat in the water with possible damage from marine organisms which may attach themselves to the hull of the boat while it is submerged in the water.

Consequently, many people who have a floating dock on navigable water will use a boat lift to protect their boat from wave and wake action, as well as from marine organisms. A boat lift ordinarily consists of a set of pilings. Secured on these pilings is a structure which is heavier than water, which has a set of rails on which the hull of the boat may rest. The structure supporting the rails is ordinarily attached by pulleys to at least one cable, which is connected to a reel and an electric motor. The reel acts like a winch to extend or retract the cable. As the cable extends, it lowers the structure relative to the pilings and as the cable retracts, it raises the structure relative to the pilings. The pilings, structure, cable, and winch will be rated for a particular weight, which will be the dry weight of the boat for which the lift is proposed to be used. To use the lift, the supporting structure is lowered in the water by unwinding the cable from the reel. The user then guides or pilots the boat onto the rails or other supporting structure and then activates the winch to rewind the cable, thus lifting the structure with the boat now supported by the structure. The cable is continued to be rewound until the boat is entirely lifted out of the water. This accomplishes two desirable outcomes. First, the hull of the boat is no longer exposed to marine organisms in the water. Secondly, because the boat is no longer in water, wave or wake action will not affect the boat, so it will be secured against damage from impacts caused by the wave, current, or wake action.

For both ease of construction and economy of construction, most boat lifts simply have a structure that is lowered into the water and sinks in the water from the force of gravity. The structure is lifted and lowered by the flexible, albeit inelastic cables. Typically, only one or two cables are used to lower and to raise the structure on which the boat rests. Moreover, because piloting a boat is not an exact science, the pilings on which the boat lift is supported are ordinarily substantially wider than the width or beam of the boat for which the lift is designed. Thus, the boat lift structure on which the boat is supported may move around if it is subject to forces in horizontal plane relative to the vertical direction of the lifting and lowering motion of the boat lift structure supported by the cables. Thus, as one maneuvers a boat onto a boat lift to be raised out of the water, there is a period of time where the boat is floating in the water. Hence, currents within the water, wind action on the boat, wakes, and the like can cause a boat to be moved in the horizontal plane. This is true, even after the lift has started operating, where the boat may be partially supported by the lift structure during the motor retracting the cable, but still within the water and subject to the force of wave or a boat wake. This period of time, where the boat is inside the pilings but not fully raised by the lift out of the water, can be dangerous both for operators of the boat and to the boat itself.

A variety devices have been proposed to overcome the difficulty of docking a boat, while not specifically proposed for a boat lift, that recognize that wind and current and rough water may exacerbate the difficulty of guiding a boat into a narrow area. For example, Capps U.S. Pat. No. 5,113,702 discloses vertical padded boat guards extending from the side walls of a dock. A boat slides between the vertical guards and is secured against padded stop members positioned toward the boat bow. Likewise, Ryan U.S. Pat. No. 5,911,189 discloses boat guides that are used for guiding a boat in and out of a boat slip. Having elongated tubular members, an axil is received coaxially within the tubular member with padding or at least space between the tubular member and the axil to deflect forces relative to an impact from the boat. Godbersen U.S. Pat. No. 6,554,533 discloses a dry dock or boat lift using hydraulics. Here, there is a framework which rests on the ground, which proposes a hydraulic means of lifting the boat on a four-post rectangular frame structure. The movable framework is operatively connected to a pulley and cable suspension system to raise and lower the suspension system secured on the four vertical posts.

While these devices are useful in themselves and, to some degree, recognize the problems that a boater may have in piloting a boat into a docking area, they do not recognize the problem for standard boat lifts caused by wind current, waves, or wakes like those that might be seen in a river or along the intracoastal waterway, nor do they suggest a system which can be used on existing boat lifts to solve the problem created by current, wind and wave action, and wakes for an individual boater trying to use a boat lift to get a boat in or out of the water.

SUMMARY OF THE INVENTION

The current invention, while simple in structure, is ingenious in design and solves an otherwise unmet need to secure the boat lift structure on which a boat is raised and lowered in and out of the water in a boat lift against movement in a horizontal plane. A typical boat lift will use at least one flexible inelastic cable and pulleys mounted on beams to raise and lower a structure on which a boat rests as the boat is lifted in an out of the water. The beams themselves are horizontally mounted on vertical pilings or posts, which are typically set in the sand or soil beneath the water. The pilings are ordinarily spaced apart and at an appropriate length and width for the lift for boats of a particular size. The invention consists of an extended pipe-like device mounted on the boat lift submersible structure and capable of reaching to an adjacent piling. This extended pipe like device is resistent to damage from repeated exposure to water, especially salt water. For example, it could consist of galvanized pipe. Ordinarily, it would be appropriate at the points of the extended pipe of the device, which would be in proximity to adjacent pilings, to add an outer covering which might consist of a piece of PVC pipe which will readily rotate or roll in response to the vertical motion caused by the raising and the lowering of the boat lift. The extended pipe-like device would be mounted on the submersible lift structure at a predetermined distance from the adjacent pilings. This means that should the submersible lift structure be subject to a force in the horizontal direction, movement in the direction of that force would be restricted because the submersible lift structure would be held into place against the rigid vertical piling by the pipe-like device, hence securing the submersible lift structure from movement in that direction. For some pilings, it may be only necessary to add one pipe-like device since the direction that one may have current or wave action may be stereotypical and predictable. However, in the event that wind or wave action may be unpredictable, it might be necessary to have as many as eight pipe-like devices, which would secure the lift structure from excessive movement on four pilings from all horizontal directions. This invention is readily adaptable to current boat lifts both as an add-on structure as the boat lift is constructed or as an after-market accessory to be used on existing boat lifts. It does not require modification of the structure of the lift itself nor of the cables which raise and lower the lift. It is simple and inexpensive to build, durable in operation, and protects both the boats and the occupants from excessive motion in a horizontal plane caused by wind, wave, wake, or currents in the water.

DETAILED DESCRIPTION OF THE DRAWINGS

Figure 1A:
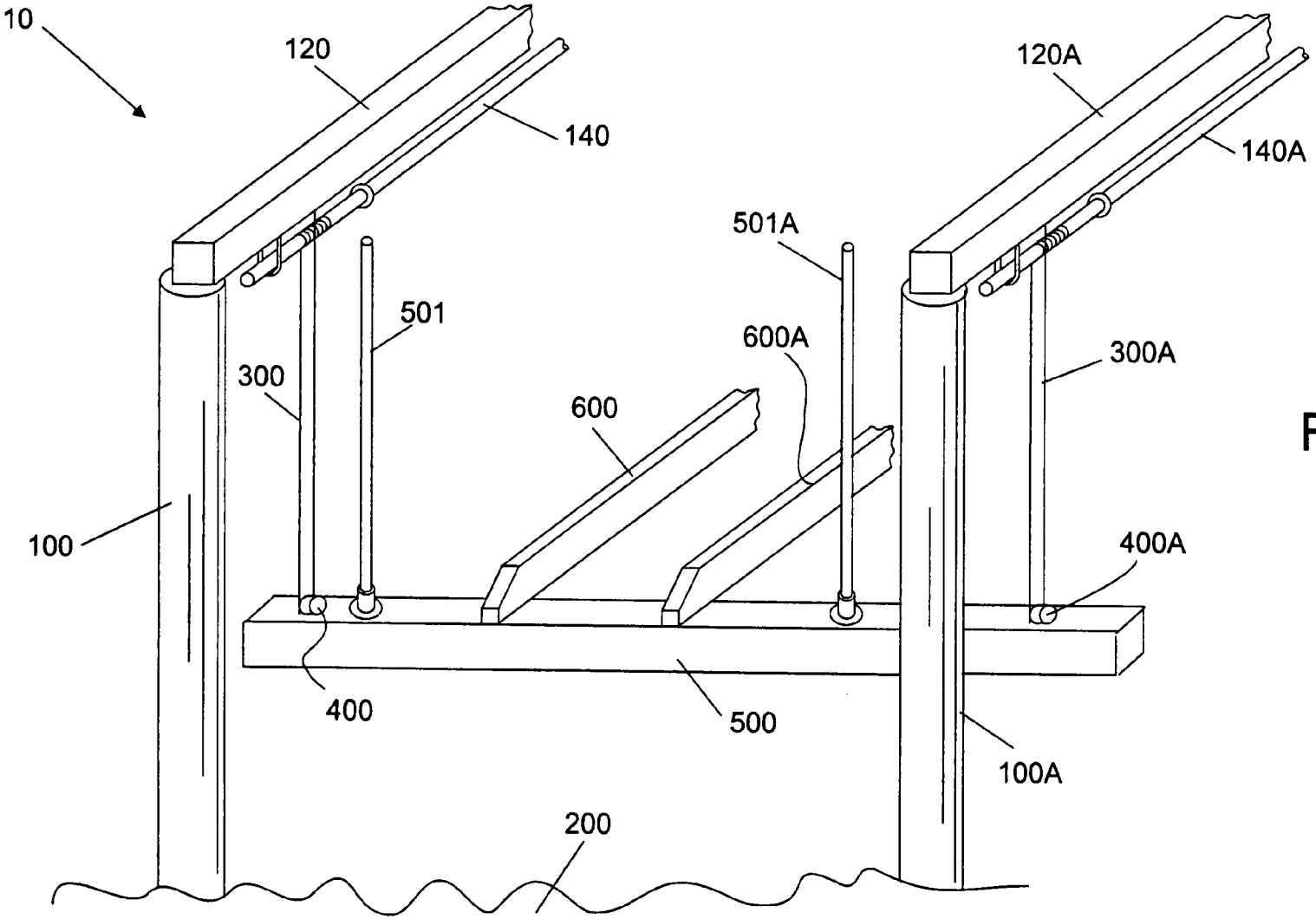
FIG. 1A Prior Art
FIG. 1A shows a prior art boat lift in partial perspective view from one end.

FIG. 1A shows a prior art boat lift (10) seen from the front and in a partial view. As will be understood and shown in later figures, there are matching structures to the rear of the structure shown in FIG. 1A. Two pilings (100) and (100A) are seen extending into the water (200). On top of the pilings (100) and (100A) are lift support beams (120) and (120A). Immediately below the lift support beams (120) and (120A) are cable pipes (140) and (140A). This will be seen in more detail in FIG. 1B. Two cables (300) and (300A) are seen respectively positioned under the lift support beam (120) and (120A). One end of each cable (300, 300A) attaches directly to the lift support beams (120) and (120A). The other end of each cable is coiled upon the cable pipes (140) and (140A). As the cable pipes (140) and (140A) rotate, they will either wind or unwind the cables (300) or (300A) on the cable pipes (140) and (140A). The cables (300) and (300A) are attached to pulleys (400) and (400A) which are attached to a boat support beam (500). Attached to the boat support beam (500) are two guide poles (501) and (501A) and two hull support beams (600) and (600A). This will be more clearly visualized in the side view seen in FIG. 1B.

Figure 1B:
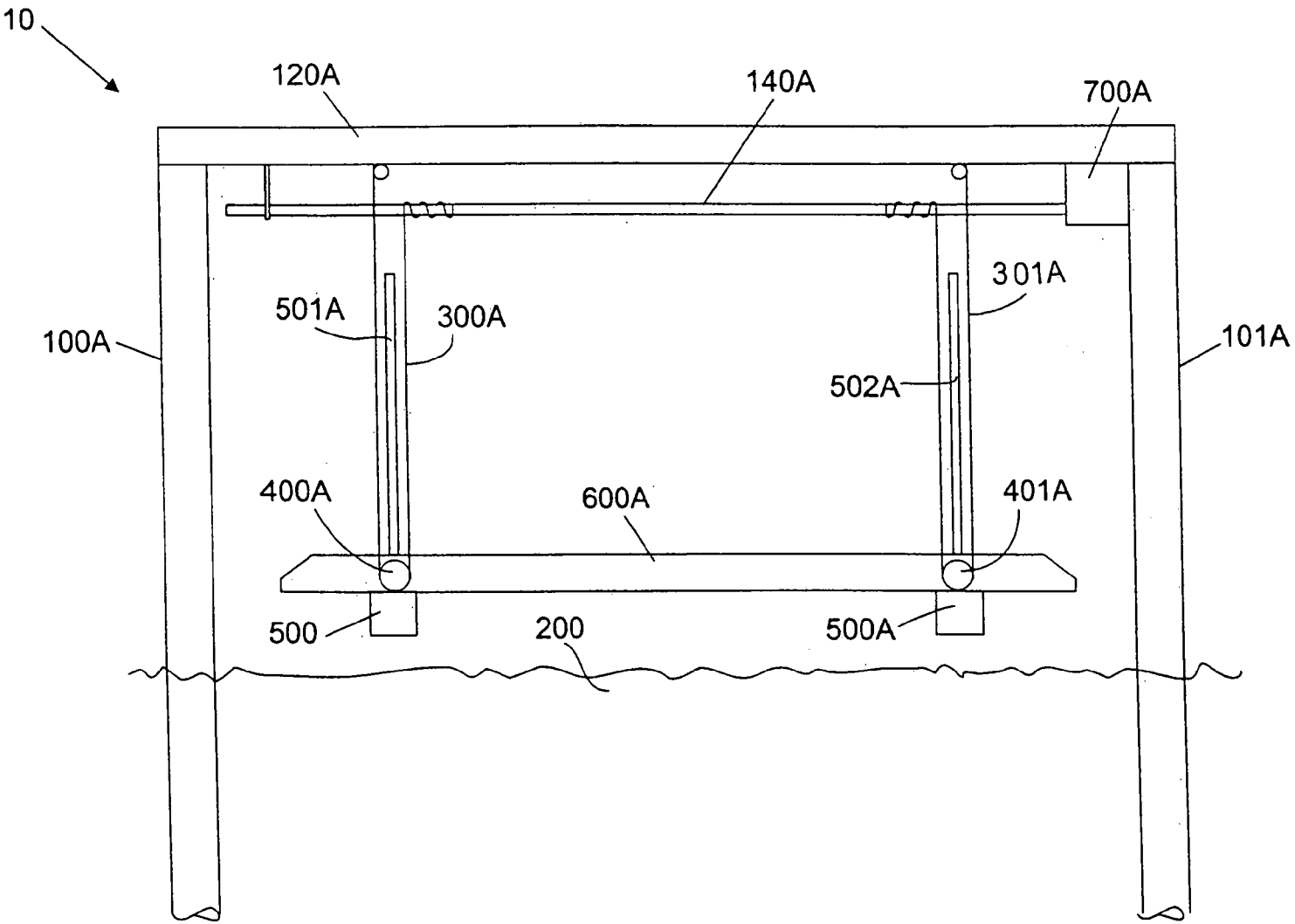
FIG. 1B Prior Art
FIG. 1B shows a prior art boat lift seen from one side.

FIG. 1B shows one side of the boat lift (10) seen from a side view, which more clearly shows the piling (100A) side of the boat lift (10). It will be understood there are duplicates of the features seen in FIG. 1B on the other side of the boat lift (10) which are not seen in this view. Here, the piling (100A) is seen with the lift support beam (120A) supported at the top of the piling (100A) and supported on piling (101A), which is not seen in FIG. 1A. Suspended from the lift support beam (120A) is the cable pipe (140A). Cables (300A) and (301A) are seen respectively attached to the lift support beam (120A) and wrapped on the cable pipe (140A). A cable winch mechanism (700A) is seen positioned below the boat support beam (120A) and adjacent to the piling (101A). This ordinarily will contain an electric motor and appropriate gears to rotate the cable pipe (140A). As the cable pipe (140A) rotates, it will either wind or unwind the cables (300A) and (301A) which extend respectively to the pulleys (400A) and (401A). As each cable unwinds from the cable pipe (140A), this has the effect of lowering the boat support beams (500) and (500A) and hull support beam (600A) and the unseen hull support beam (600). Ordinarily, these structures are heavier than the water (200), so as the cable extends sufficiently, it will lower the boat support beams (500) and (500A) and hull support beams (600) and (600A) into the water to be submerged, leaving the guide poles (501A) and (502A) above the water. Someone who wishes to use the boat lift (10) will then steer the boat between the guide pole (501A) and the now unseen guide pole (501) (shown in FIG. 1A), thus positioning the boat above the hull support beams (600) (not shown) and (600A). The cable winch mechanism (700A) may be reversed and the matching cable winch mechanism (700) (unseen in this view) will also be reversed, which results in the cable being wound onto the cable pipes (140) and (140A), shortening the cables (300, 301, 300A, 301A) and raising the now supported boat from the water.

Figure 2:
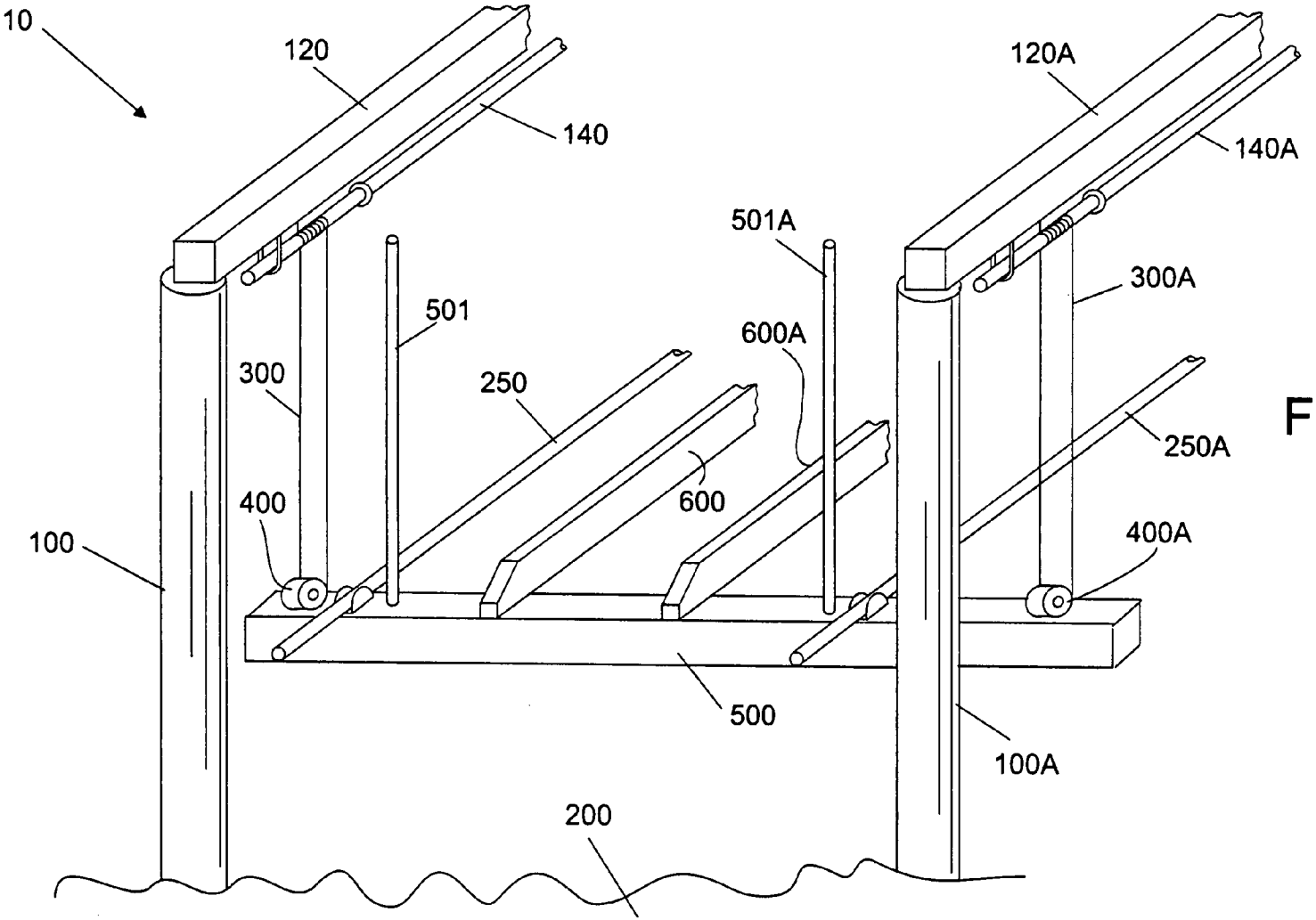
FIG. 2 shows the current invention mounted on a boat lift when seen from a front partial perspective view.

FIG. 2 is a partial front prospective view which shows the invention stabilizer pipes (250) and (250A) in place where they are fixedly mounted on the boat support beam (500). The structures at the rear of the boat lift (10) is not shown in this view. The stabilizer pipes (250) and (250A) can be mounted to the boat support beam (500) in a variety of ways. Ordinarily, the stabilizer pipe invention will be an add-on device attached to existing boat lifts or at least as an after-market accessory to be added to a boat lift during installation. Therefore, the stabilizer pipes (250) and (250A) will ordinarily be bolted in an appropriate way to the boat support beam (500) and the unseen boat support beam (501).

However, it can be made a factory accessory for a boat lift or it can be made an integral part of the boat support beam (500) or at least could pass through a mounting hole in the boat support beam (500), as opposed to being bolted to the top or bottom of the boat support beam (500). Because the stabilizer pipes (250) and (250A) are frequently immersed in water, it needs to be made of materials that are resistant to corrosion. Also, because it is used to brace the boat against forces, it needs to be sufficiently strong and rigid to withstand considerable force and impact. Typically, a galvanized iron pipe can serve as a base for a stabilizer pipe (250). However, the stabilizer pipes (250) and (250A) should also be constructed so as not to damage existing structures when in use the pilings (100), (100A), (101) and (101A). The function of the stabilizer pipes (250) and (250A) will be seen more clearly in FIG. 3.

Figure 3:
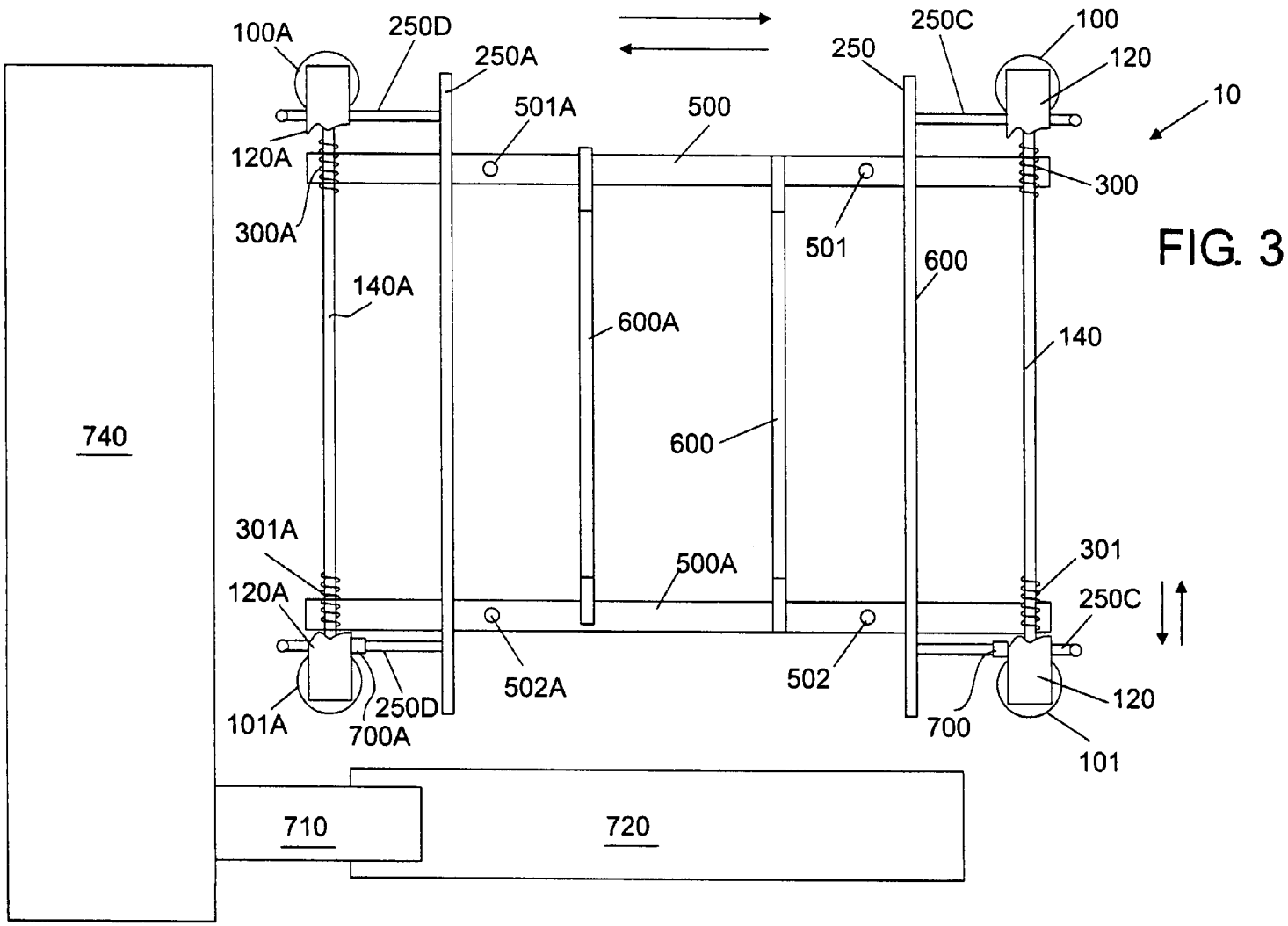
FIG. 3 shows the current invention on a boat lift seen from above.

FIG. 3 is a boat lift (10) (not to scale) seen from above with the stabilizer pipes (250), (250A), (250C), and (250D) seen in place on the boat support beams (500, 500A) of the boat lift (10). To the left side of the drawing is a pier (740), which uses a ramp (710) to a floating dock (720), which is at the rear or land side of the boat lift (10). A prospective user will use the cable winch mechanisms (700) and (700A) to unwind the cables (300), (300A), (301), and (301A) which will lower the boat support beams (500) and (500A) beneath the water. The hull beams (600) and (600A) will also be lowered beneath the water. Stabilizer pipes (250), (250A), (250C), and (250D) will be submerged as the boat support beams (500) and (500A) are submerged. Since many boats are used on boat lifts which are used for fishing offshore, the boat may actually have a three-foot draft with a V-shaped hull. Consequently, the boat support beams (500) and (500A) with the hull support beams (600) and (600A) must be submerged sufficiently deep that a user will be able to maneuver a boat into the hull support beams (600) and (600A) using the guide poles (501, 501A, 502, 502A). A user maneuvers a boat so that the hull support beams (600) and (600A) will be positioned beneath the hull of the boat, so that the cable winch mechanism (700) and (700A) may be used to begin the process of raising the boat out of the water. In lake waters this maneuver is usually relatively easily accomplished. The boat can be maneuvered onto the appropriate location. The user can dismount from the bow of the boat onto the floating dock (720) and activate the cable mechanisms (700) and (700A) to begin the process of raising the boat out of the water. In FIG. 3, the lift support beams (120) and (120A) are shown in partial cut-a-way in order to visualize the cable pipes (140) and (140A) which are ordinarily mounted below the lift support beams (120) and (120A). The cables (300A) and (301A) are shown wrapped around the cable pipe (140A) and the cables (300) and (301) are wrapped around cable pipe (140). Again, it will be appreciated, as is seen in FIG. 2, that these cables (300A), (301A), (300), and (301) extend to the boat support beams (500) and (500A). As the cable winch mechanism (700) and (700A) are activated, it will rotate the cable pipes (140) and (140A) to wind the cable (300A, 301A, 300, and 301) to raise the boat support beams (500) and (500A), thus, raising the boat now supported on the hull support beams (600) and (600A).

However, the circumstance can be considerably different in a river or in a tidal water area that are subject to currents. It is presumed in FIG. 3 that the stabilizer pipes (250) and (250A) are used as a boat lift (10) in an area like the Intracoastal Waterway. The Intracoastal Waterway is frequently subject to considerable effects from tides, since the Intracoastal Waterway may be just behind a barrier island, a marsh, or otherwise separated from the ocean by a narrow strip of land. As the tides rise, the water comes into the Intracoastal Waterway and as the tides fall, water flows from the Intracoastal Waterway through an inlet into the ocean. This can result in a current shown by the two arrows at the top of FIG. 3. It will be presumed that the arrow pointing to the viewer's right is as the tide is rising and the arrow pointing to the viewer's left is as the tide is falling. The Intracoastal Waterway is in many areas a man-made excavation in which there may be a large tidal area, marsh, or the like on each side of the connecting excavation or ditch which forms the body of the Intracoastal Waterway. This means that in that area the Intracoastal Waterway is relatively narrow compared to the two areas on either side, which may be large or extensive tidal marshes or another tidal basin. Consequently, during the peak of the tidal flow large volumes of water will be forced into a relatively narrow ditch, which causes significant currents flowing at several miles per hour. This creates lateral forces. The beams of the boat support beams (500) and (500A) and the hull support beams (600) and (600A) have a considerable profile which will be subject to lateral forces created by the moving water in the Intracoastal Waterway. Thus, when the tide is coming in and the current is flowing to the viewer's right, it will force the entire submerged structure of a boat lift (10) toward the viewer's right. The lift support beams (120) and (120A) usually will be significantly above the level of the water. If there is a four or five foot tide, then these lift support beams (120) and (120A) will need to be positioned sufficiently above the highest tide levels in order to secure the boat onto the boat lift (10). This means there is considerable length to the cables (300, 301, 300A, 301A), hence play in the cables, when extended. Thus the entire structure, which is used to support the boat and to be lifted by the cables (300, 301, 300A, 301A), may be forced by the tide current to either the viewer's left or right, depending on the direction the tide is moving. In fact, the boat support beams (500,500A) can be forced between the pilings (100, 101) or (100A, 101A) making it difficult to even guide a boat onto the hull support beams (600) and (600A). Consequently, there is a need to stabilize the hull support beams (600) and (600A), which are actually used to support a boat as the boat lift (10) is operating. Here, the stabilizer pipes (250) and (250A) extend so that they limit the motion both to the left and right because they will limit the lateral motion of the hull support beams (600) and (601) of the boat lift (10) when the tide is flowing to the right or to the left. In both cases the stabilizer pipe (250) or (250A) will be pushed by the tide so that the stabilizer pipe (250) will be pressed against the pilings (100, 101) or stabilizer pipe (250A) against pilings (10A, 101A).

In most applications, the boat lift (10) will be pulled in a stereotypical fashion by currents in either a river or in an intracoastal waterway. However, in some applications, the boat lift (10) may be subject to forces from a variety of directions. In that unusual case, additional stabilizer pipes (250D) may be attached to stabilizer pipe (250A) and additional stabilizer pipes (250C) may be attached to stabilizer pipe (250). These additional stabilizer pipes (250C) and (250D) secure the boat lift (10) from motion in the directions shown by the vertical arrows from the viewer's perspective at the bottom right of FIG. 3. They are constructed and operated in the same fashion as stabilizer pipes (250A) and (250). As before, the stabilizer pipes, whether (250A) and associated additional stabilizer pipe (250D) or stabilizer pipe (250) and associated additional stabilizer pipe (250C), use the pilings (100, 100A, 101, 101A) to secure the boat lift (10) from undesirable motion.

Figure 4:
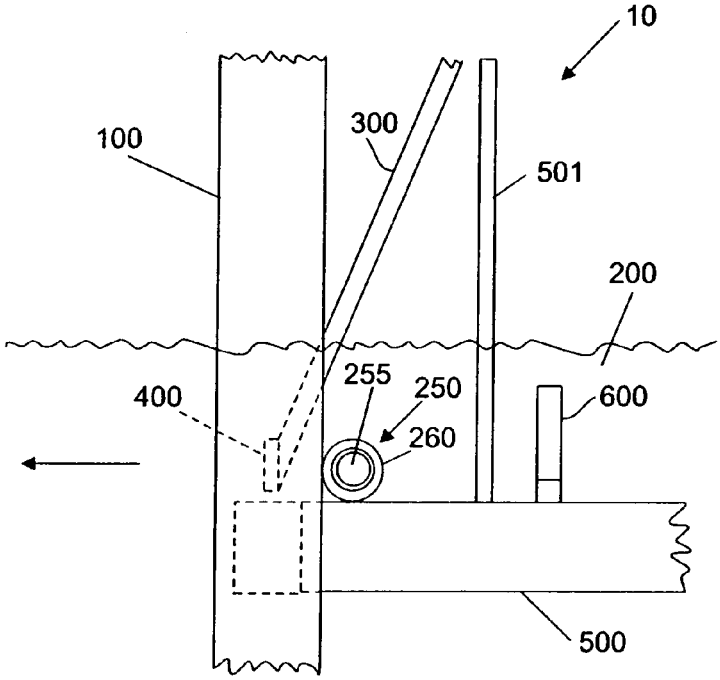
FIG. 4 shows the current invention seen in detail from the front when resisting movement caused by current in water.

FIG. 4 shows in a partial detail view how the stabilizer pipe (250) works in conjunction with the piling (100) of the boat support beam (500). Only one corner of the stabilizer pipe invention is shown. It will be appreciated that at each of the four pilings (100), (100A), (101), (101A) the invention will work as described here. The stabilizer pipe (250) (seen from the end) is fixedly mounted to the boat support beam (500). It extends out and away from the boat support beam (500) to where the end of the stabilizer pipe (250) extends beyond the piling (100). Consequently, when there is a current flow, indicated by the arrow in FIG. 4, it will tend to push the hull support beam (600) to the viewer's left, as well as the boat support beam (500) to the left in the water (200). Because the cable (300) is flexible and is mounted on the pulley (400), there is enough play for the submerged parts of the boat lift (10) to be pushed by the current to the viewer's left. However, the stabilizer pipe (250) now extends beyond the piling (100) and, before the boat support beam (500) can be pushed any further to the left, the stabilizer pipe (250) contacts the piling (100) to limit lateral motion. As shown in FIG. 4, this is as far to the left as the boat support beam (500) can be pushed by the current. Typically, the stabilizer pipes (250) and (250A) (not seen in this view) will be positioned to allow some minor degree of play or lateral motion. As can be seen in FIG. 4 and in detail in FIG. 5, the stabilizer pipe (250) is ordinarily constructed of an inner hard, inflexible material like a piece of galvanized pipe, which forms the support core (255) of the stabilizer pipe (250). In order to facilitate operation of the stabilizer pipe (250) and to reduce damage to the piling (100) there will ordinarily be, over the portion of the stabilizer pipe (250) that is apt to come into contact with the piling (100), a softer rotatable outer covering (260). For example, if one is using a galvanized pipe, a PVC pipe can simply be positioned over a portion of the galvanized pipe, which then will form the outer covering (260) with the galvanized pipe forming the inner core (255). The outer covering (260) is softer than the inner core (255) and will be mounted such that it can roll, so when the stabilizer pipe (250) is in contact with the piling (100), the outer covering (260) will simply roll in response to vertical motion induced by the cables (300) as the boat lift (10) is being lowered or raised. The outer covering (260) could have an even softer foam-like outer covering. It could be mounted on roller bearings and a variety of other expedients are possible to maximize the function of the stabilizer pipe (250) regarding its contact with the piling (100). However, it has been found in practice that a simple galvanized pipe with an appropriate polyvinyl chloride pipe covering works well.

Figure 5:
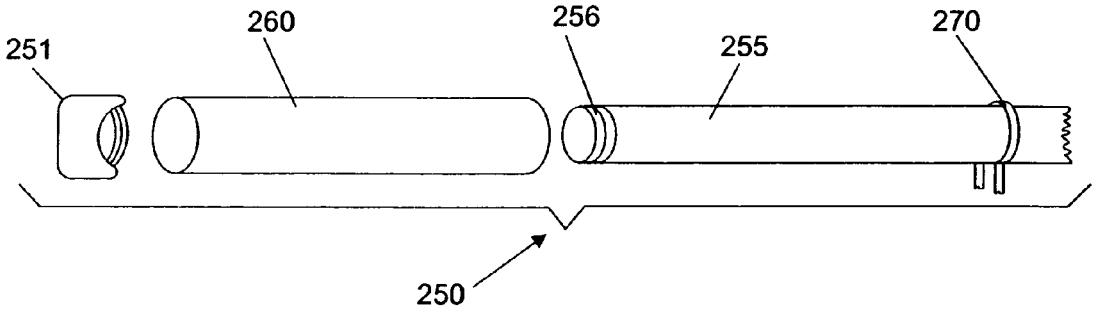
FIG. 5 is a partial exploded detail view of the current invention.

FIG. 5 is an exploded view that shows in more detail construction of one end of the stabilizer pipe (250). The galvanized pipe (255) is shown with a piece of PVC pipe outer covering (260) slightly larger than the galvanized pipe ready to slip in place over the galvanized pipe (255). The outer covering (260) will be secured in place by a u-bolt (270) which is also used to secure the stabilizer pipe (250) to the boat support beam (500) (not shown). At one end of the galvanized pipe (255) are threads (256) a galvanized cap (251) threads onto the end of the galvanized pipe (255) by means of the threads (256) to secure the outer covering (260) in place. It will be understood that this is a very simple method of construction using existing materials for the stabilizer pipe (250). However, other constructions are certainly possible. The stabilizer pipe (250) could be made of a solid non-corrosive material including aluminum or plastic. The outer covering (260) could be mounted on roller bearings. It has been found in practice that the construction described in FIG. 5 is adequate and works well for many applications, is inexpensive, can be constructed from off-the-shelf materials and readily adapts to existing boat lifts as well as easily is added to boat lifts as they are being built. It will be readily appreciated that where a water flow in which a boat lift (10) is used flows in one direction only, perhaps only one stabilizer pipe (250) would be required. In most applications, at least two stabilizer pipes will be required to secure the boat lift (10) from undesirable motion and, in some applications, more than two may be required. The exact manner and construction of the stabilizer pipe is largely a matter of convenience and different materials and fabrication could be employed without departing from the essential teaching of this invention. The foregoing explanation and Detailed Description of the Drawings is by way of illustration and not by way of limitation. The only limitation is found in the claims which follow.

I claim:

1. A device to be secured to a submersible portion of a boat lift to stabilize the submersible portion of a boat lift from unwanted lateral movement caused by current, wave, or wind action comprising at least one rigid piece, said at least one rigid piece secured to a submersible portion of a boat lift, said rigid piece mounted on a submersible portion of a boat lift generally parallel to a surface of water and located between a boat hull supporting structure on said submersible portion of a boat lift and a piling supporting a boat lift whereby said at least one rigid piece is in proximity to said piling and limits the amount of lateral motion of the submersible portion of a boat lift on which said rigid piece is mounted by contact with a piling.

2. A device to be secured to a submersible portion of a boat lift to stabilize the submersible portion of a boat lift from unwanted lateral movement caused by current, wave, or wind action of claim 1 further comprising said at least one rigid piece for each of at least two pilings, whereby said at least one rigid piece is in proximity to said one of at least two pilings and limits the degree of lateral motion of the submersible portion of a boat lift on which said one of at least one rigid piece is mounted by contact with one of at least two pilings.

3. A device to be secured to a submersible portion of a boat lift to stabilize the submersible portion of a boat lift from unwanted lateral movement caused by current, wave, or wind action of claim 2 further comprising said at least one rigid piece for each one of a plurality of pilings.

4. A device to be secured to a submersible portion of a boat lift to stabilize the submersible portion of a boat lift from unwanted lateral movement caused by current, wave, or wind action of claim 3 wherein at least one rigid piece is a generally elongated cylindircal piece secured to a submersible portion of the boat lift.

5. A device to be secured to a submersible portion of a boat lift to stabilize the submersible portion of a boat lift from unwanted lateral movement caused by current, wave, or wind action of claim 4 wherein said at least one generally elongated cylindrical piece further contains means for cushioning contact between said at least one generally elongated cylindrical piece and each of said plurality of pilings.

6. A device to be secured to a submersible portion of a boat lift to stabilize the submersible portion of a boat lift from unwanted lateral movement caused by current, wave, or wind action of claim 5 wherein, for each piling of plurality of pilings, there is a first generally elongated cylindrical piece and a second generally elongated cylindrical piece, said first generally elongated cylindrical piece mounted to said second generally elongated cylindrical piece at a generally right angle.

7. A generally elongated cylindrical device in combination with a submersible portion of a boat lift and pilings used to support said boat lift comprising, for each of said pilings, a generally elongated cylindrical device secured to said submersible portion of a boat lift generally parallel to a surface of water and in proximity to said piling.

8. A generally elongated cylindrical device in combination with a submersible portion of a boat lift and pilings used to support said boat lift of claim 7 wherein said generally elongated cylindrical device contains means for cushioning contact between said generally elongated cylindrical device and said piling.

9. A generally elongated cylindrical device in combination with a submersible portion of a boat lift and pilings used to support a boat lift of claim 8 wherein said generally elongated cylindrical device is constructed of corrosion-resistant materials.

10. A method to stabilize the submersible portion of a boat lift from unwanted lateral movement caused by wave, wind, or current action comprising:

(a) providing at least one rigid piece;

(b) securing said at least one rigid piece to a submersible portion of a boat lift, said at least one rigid piece secured generally parallel to a surface of water and located between a boat hull supporting structure on said submersible portion of said boat lift and a piling supporting said boat lift whereby said securing at least one rigid piece limits the amount of lateral motion by contacting said piling.

11. A method to stabilize the submersible portion of a boat lift from unwanted lateral movement caused by wave, wind, or current action of claim 10 further comprising securing at least one rigid piece located between a boat hull supporting structure on said submersible portion of a boat lift and a piling for each piling on which a submersible portion of a boat lift is mounted.

12. A method to stabilize the submersible portion of a boat lift from unwanted lateral movement caused by wave, wind, or current action of claim 11 wherein said providing at least one rigid piece further includes providing a generally elongated cylindrical piece.

13. A method to stabilize the submersible portion of a boat lift from unwanted lateral movement caused by wave, wind, or current action of claim 12 wherein providing said at least one generally elongated cylindrical piece further includes providing means for cushioning contact between said at least one generally elongated cylindrical piece and each of said pilings.

* * * * *